US006398086B1

(12) United States Patent
Bennett

(10) Patent No.: US 6,398,086 B1
(45) Date of Patent: Jun. 4, 2002

(54) MODIFIED APPAREL ACCESSORIES RACK

(75) Inventor: Erith L. Bennett, 13016 Ingleside Dr., Beltsville, MD (US) 20705

(73) Assignee: Erith L. Bennett, Beltsville, MD (US)

( * ) Notice: Subject to any disclaimer, the term of this patent is extended or adjusted under 35 U.S.C. 154(b) by 0 days.

(21) Appl. No.: 09/757,569

(22) Filed: Jan. 11, 2001

Related U.S. Application Data

(63) Continuation-in-part of application No. 09/410,076, filed on Oct. 10, 1999, now Pat. No. 6,196,396.

(51) Int. Cl.[7] ..... A47F 7/00

(52) U.S. Cl. ..... 223/87; 223/85; 223/DIG. 1; 211/85.3; 211/113; 211/85.2

(58) Field of Search ..... 223/85, 87, 92, 223/88, DIG. 1; 211/85.3, 113, 85.2

(56) References Cited

U.S. PATENT DOCUMENTS 2,077,316 A * 4/1937 Geib ..... 211/87
2,492,226 A * 12/1949 Kohl et al. ..... 211/89
D191,647 S * 10/1961 Seeger ..... D80/8
3,081,881 A * 3/1963 Seeger ..... 211/13
3,783,995 A * 1/1974 Tobin ..... 206/7
3,945,500 A * 3/1976 Mecksroth ..... 211/113
5,934,524 A * 8/1999 Gray ..... 223/85
6,196,396 B1 * 3/2001 Bennett ..... 211/85.3

* cited by examiner

*Primary Examiner*—Rodney M. Lindsey
*Assistant Examiner*—James G Smith
(74) *Attorney, Agent, or Firm*—Robert Halper

(57) ABSTRACT

A shaped figure designed for suspending apparel accessories such as ties, belts, scarfs and the like wherein the figure comprises a flat plate of injection molded plastic having cutouts configured to form a series of downwardly inclined sets of steps, wherein a lower set is parallel to an upper set. The shaped figure is coated with fluorescent paint.

A modification of the above is optionally designed with but one set of steps and the steps converge or diverge toward a centered stem or stems. A support block integral with a hook extends from a centered stem. The block as well as a base and a pair of arcuate sections can be apertured to enable the insertion of a fastener to support the rack.

9 Claims, 7 Drawing Sheets

1
2
2a
3
4
5
6
7
7
8
10
11
12

MODIFIED APPAREL ACCESSORIES RACK

This application is a continuation in part of allowed application Ser. No. 09/410,076, filed on Oct. 10, 1999 U.S. Pat. No. 6,196,396.

FIELD OF INVENTION

This invention pertains to racks or hangers for clothing accessories such as ties, belts and scarfs.

BACKGROUND OF THE INVENTION

The art is replete with racks of various designs as exemplified by the patents enumerated below, subdivided into Design and Utility patents.

D U.S. Pat. No. 167,986 depicts a tiehanger using the basic frame of a clothes hanger wherein the transverse rod that normally supports a garment is extended to two outward inclined legs. Along the inclined legs, adjacent, arcuate pockets are formed on each leg at several levels. Each pocket supports a tie.

D U.S. Pat. No. 211,795 shows a tierack with a hook at its upper end for attachment to a shaft. Suspended from the hook are a plurality of aligned, zig-zag surfaces, each surface used for mounting ties at the bottom end of the aforesaid zig-zag surfaces. At the bottom of the device there are a pair of parallel hooks perpendicular to the hook above the zig-zag surfaces.

D 298,782 illustrates a triangular like shaped tiehanger with a vertical member bisecting its base and extending upwadly to end in a hook. At equally proportioned levels of each side is a rod supported in grooves in the triangular like member. The rods are positioned in an alternate arrangement with respect to each side.

D U.S. Pat. No. 394,557 is another clothes hanger style tierack, wherein the triangular member depending from the hook is made of a solid member of substantial thickness having a plurality of rods projecting perpendicularly outward from both sides of the solid member. The rods are equally spaced each from other at two levels. The lower level rods are interspersed between the upper level rods, and the rods on each side of the thickened member are in different planes.

U.S. Pat. No. 2,401,835 teaches a delivery rack for neckties or similar apparel. A wired hook member is is secured to a trapezoidal shaped thin plate having about five shaped openings for insertion and support of the ties. The shaped openings are arranged so that there is a central opening, spaced evenly between two upper laterally spaced openings and two lower laterally spaced openings.

U.S. Pat. No. 3,783,995 shows a tie rack using a rectangular single piece injection molded flat plastic body with a hook at its upper end. The body is reenforced by a thickened bead at its sides and upper end that terminates in a hook. A central portion between the bead ends has a plurality of transverse, vertically spaced openings in its upper region. In each of the openings is a hinged flap portion so that it can be received therein and held in place by the hinged flaps.

U.S. Pat. No. 3,887,079 shows a triangularly shaped multipurpose clothes hanger having attached to its apices an oppositely oriented triangular member. The opposite triangular member has a plurality of spaced arcuate surfaces along the inlined legs of the triangular member for mounting a number of secondary clothes hangers. This arrangement is suitable in a confined space of a small closet.

U.S. Pat. No. 3,938,667 is a combination tierack that supports untied and pretied neckties. A rectangular plate is telescopically received in C-shaped end brackets with fasteners passing through the member and bracket for attaching the rack to a vertical support surface. The rack has sockets from which posts extend, and on which neckties can be draped over. Wire loops extend between the posts. The loops have ends that are received in the sockets, and are spaced between the posts to support pretied neckties.

U.S. Pat. No. 3,951,270 depicts a tierack for preknotted neckties. The rack includes a plurality of flat wire frames supported in a horizontal row. The frames are spaced apart so as to form vertical receiving slots on both sides of the assembly. Stops are provided for supporting the lowermost tie in each receiving slot. The ties are suspended from a centered hook which is swivelly mounted.

U.S. Pat. No. 4,059,191 describes a tie rack for conventional neck ties and pretied ties, wherein a vertical leg of a flange is secured to a support member. The horizontal leg comprises a plurality of first and second slots, the second slots being separated from the first slots and having wider spacing to support knotted ties. The untied tie is looped through the adjacent first slots. Instead of using a right angles flange, a hook can extend from an intermediate vertical member and slots as described above can be fashioned on opposite horizontal members.

Accordingly it is an object of this invention to produce a simple, inexpensive structure wherein all functions are carried out by one, integrated unit.

It is a further object of this invention to design a rack or hanger which can accommodate over two dozen apparel items, all of which are easily accessible.

It is still an object of this invention to produce a product which can be suspended from a closet pole or alternatively fastened to a structure like a closet door without requiring additional accessories.

It is also an object of this invention to produce a rack or hanger which is attractive and can easily be identified in a dimly lit closet.

It is an additional object of this invention to make a variety of configurations to afford the consumer a number of options.

SUMMARY OF THE INVENTION

The rack of the present invention is a shaped structure capable of supporting a plurality of unknotted neckties or other apparel accessories. The rack can be suspended from a closet rod or the rack can be mounted on a structure such as a closet door. The rack is made from a flat, injection molded, thermosetting plastic such as a polyester. The supports for the apparel accessories are arranged in stepped fashion configured from cutouts in the plastic. The steps are symmetrically arranged on each side of the shaped structure, wherein there are at least two rows of steps spaced from each other. With the exception of U.S. Pat. No. '270, many more apparel accessories can be stored in the present device; moreover, U.S. Pat. No. '270 is for preknotted ties, which is not the usual mode of manufacture in today's market. The rack is also coated with a fluorescent paint so that it is conspicuous in a dimly lit area from amongst a multitude of clothes hangers.

The rack of this continuation in part invention describes other embodiments not shown in the original invention. For example the apparel rack can be configured to have only one set of symmetrically aligned steps. There is greater rigidity because of the use of support blocks integral with a centrally located stem. The racks can be provided with a number of perforations at different locations in the rack for insertion of a fastener for securing the rack to a support as an alternative to the use of the hook or ringlets as shown in the original invention. The steps can be cut out from converging sides or diverging sides of an overlying framework as shown in FIGS. 1 and 5 of the original application, but there are no cutouts in the frame between sets of steps.

DETAILED DESCRIPTION OF THE INVENTION

Figures 1, 2, 3, 4:
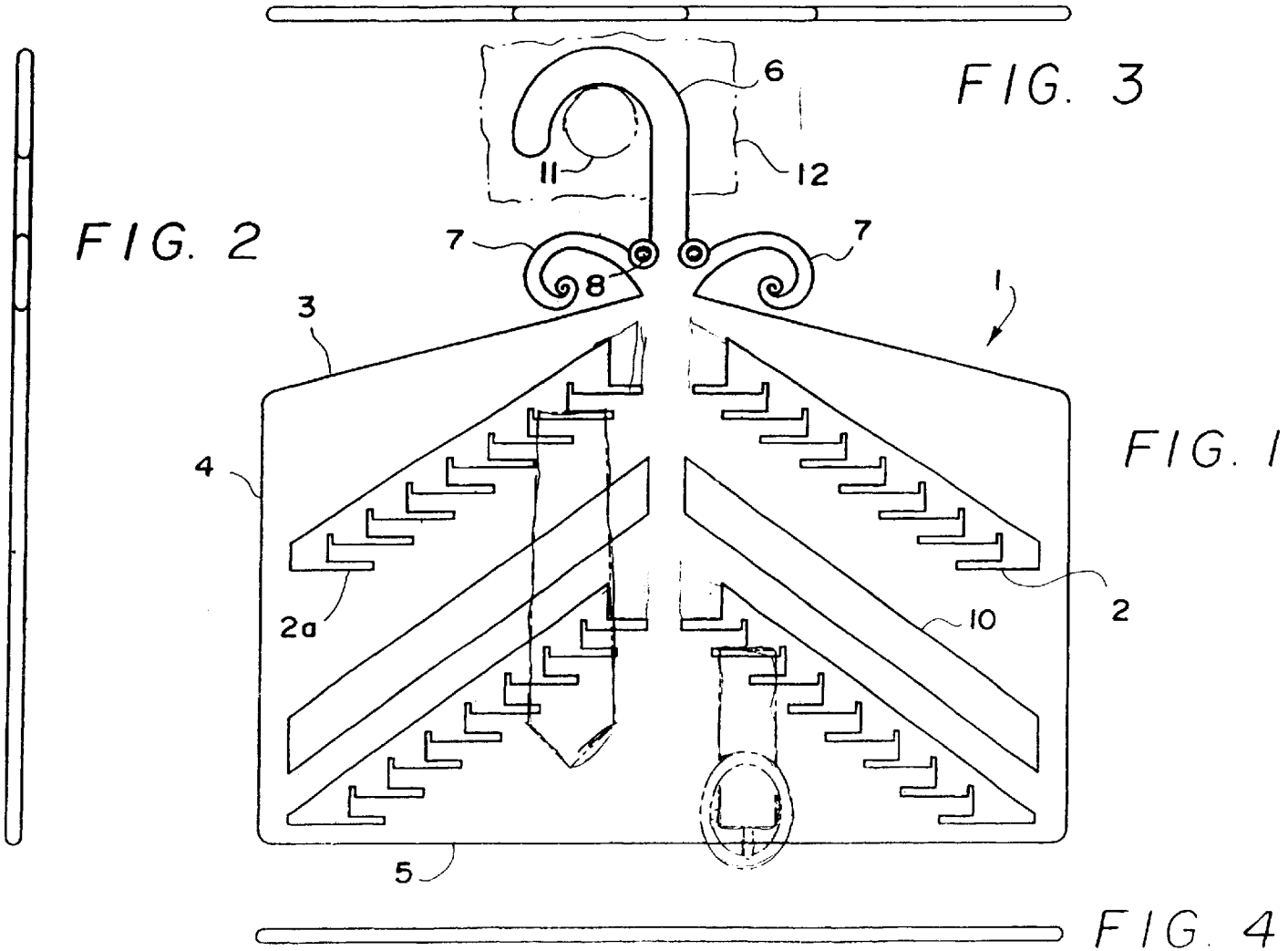
FIG. 1 is a front elevation of the invention.
FIG. 2 is a left end view of the invention.
FIG. 3 is a top plan view.
FIG. 4 is a bottom plan view.

FIG. 1 shows a rack 1 made of injection molded thermosetting plastic, and shaped somewhat like a coat hanger except that it is much longer. It is formed from a flat plate having cut outs configured with a plurality of steps 2. Starting from the top there are two downwardly divergent inclined sides 3 intersect a pair of vertical sides 4. The bottom of each vertical side intersects a horizontal base 5 to complete the structure. Integral and intermediate the two divergent sides and adjacent the divergent sides are two aligned curved members 7. These curved members terminate in a spiral shape. Between the origin of the hooked member and the origin of the curved member there are ringlets 8. Through the ringlets fasteners 8*a* are inserted and fixed in a closet structure 12. The use of ringlets with fasteners is an alternative way of suspending the rack instead of using the hook member supported on a pole 11. Within this shaped figure are two aligned cutouts configured to form a series of steps 2 as aforementioned. With respect to the pair of vertical sides the horizontal legs 2*a* of the steps are spaced inwardly and are perpendicular thereto. The steps are symmetrical and like sides 3 are divergent although not parallel to the divergent sides; however, if so desired, such a modification to design the steps to be parallel to the divergent sides is contemplated. Below and parallel to the aforementioned steps is another set of steps 2 having the same geometrical structure and the same alignment as well as the same number of steps intermediate the upper and lower sets of steps are a pair of elongate cutouts 10. These cutouts diverge in the same manner as the cutouts for the steps and are parallel thereto. The aforementioned main hook can suspend the rack from a rod 11 that is used to suspend a number of clothes hangers, or alternatively the rack can be supported by fasteners 12 that pass through the holes in the spirals of the curved members In use one apparel accessory is looped over each of the horizontal legs 2*a* of the steps, the vertical leg 2*b* acting as a backup to prevent the tie from falling off the rack. When one opens the closet, the rack can be easily spotted because of its fluorescence.

Figure 5:
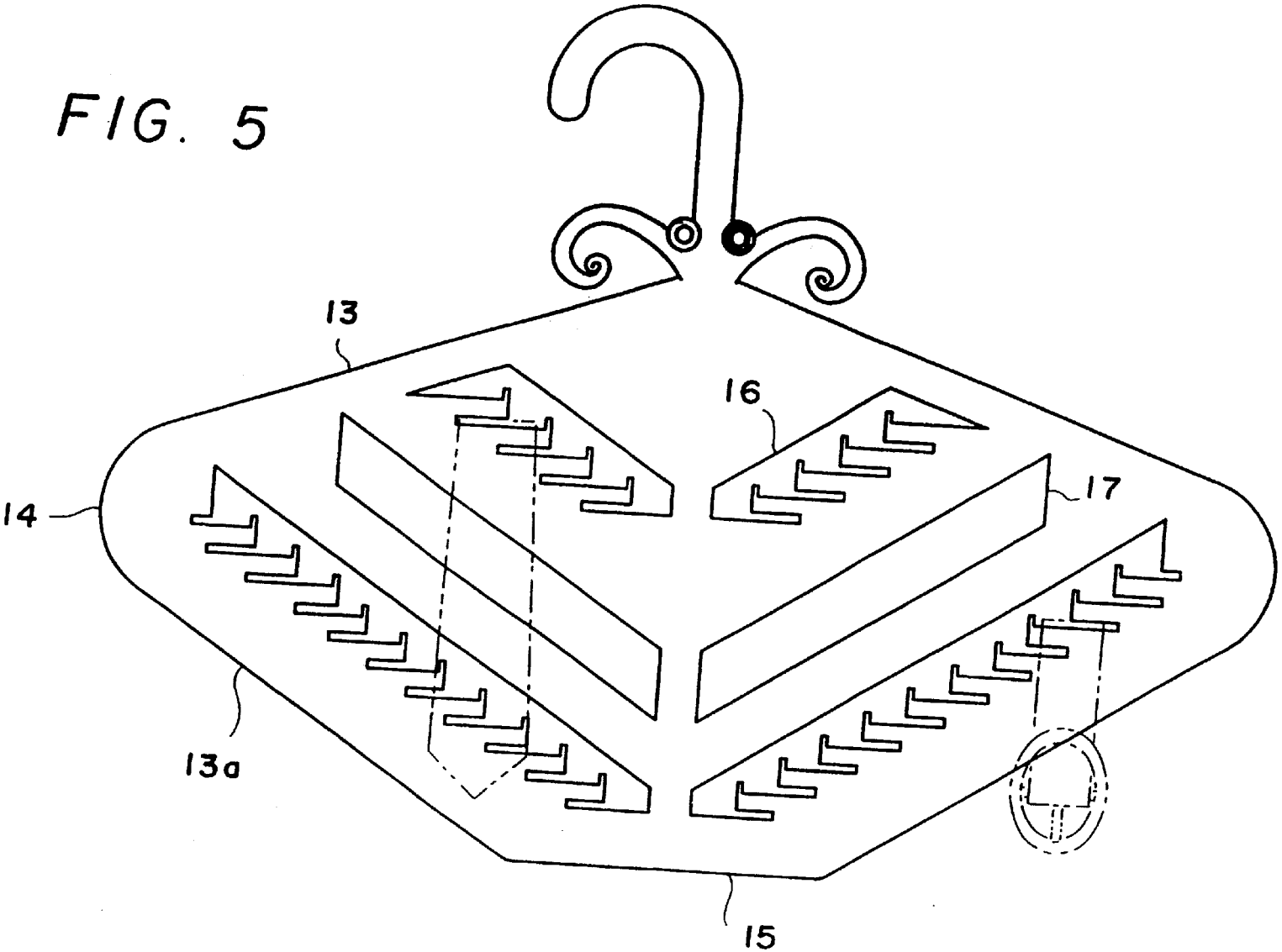
FIG. 5 is a front elevation of an alternate embodiment of the invention.

FIG. 5 shows an alternative shaped structure design having the same integrated hook and curved surfaces and steps. The steps are, however, oriented differently, and the shaped member is altered so as to resemble a baseball diamond. Starting from the top at the juncture of the hook, divergent sides 13 are joined to lower convergent sides 13*a* by a curved section 14. The convergent sides terminate in a horizontal base 15. The set of cutouts and steps 16 form an acute angle with the divergent sides if extended, and converge toward each other. The intermediate cutouts 17 have the same orientation as the steps. Additionally, while there is a second row of steps below and parallel to the first row there are a smaller number of steps at the top level.

Figure 6:
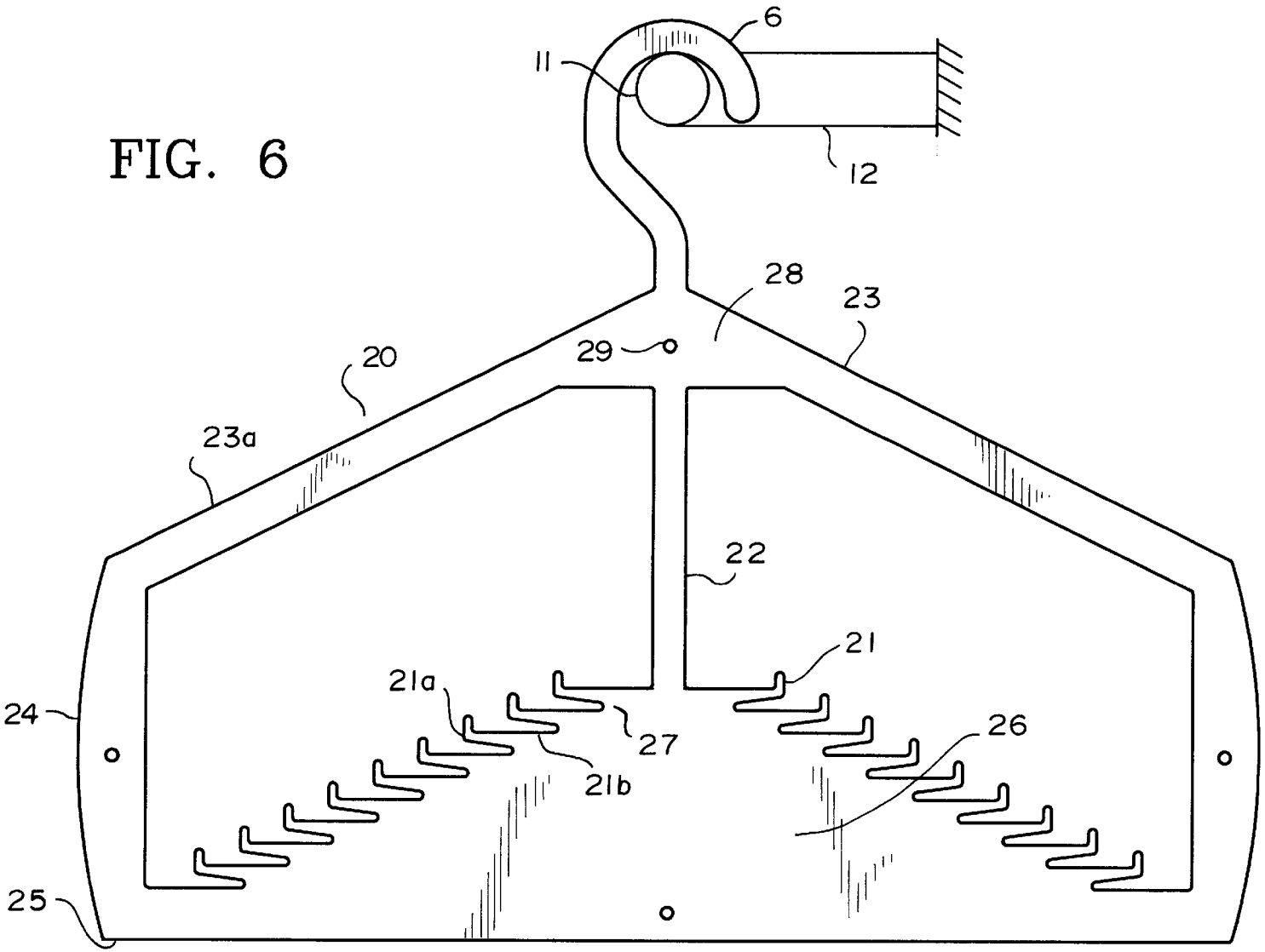
FIG. 6 is a front elevation with a single set of steps diverging from a centered stem.

FIG. 6 shows a rack 20 formed from a flat plate of injection molded thermosetting plastic and having a single set of steps 21 that diverge symmetrically from a centered stem 22. A frame 23 comprises two downwardly diverging sides 23*a* which intersect vertical arcuate members 24. The members 24 join a horizontal side 25 that is the base of a triangular like member 26. Fm this triangular like member the aforementioned steps 21 are cut out. Each pair of steps is separated by a bridge 27 with increases in width as each pair of steps incrementally diverge from the stem. Like all embodiments the steps are made of short vertical legs 21*a* and longer vertical legs 21*b* wherein the horizontal legs face inwardly toward the stem, with the last vertical legs being adjacent the base. Extending up from the stem and integral with the stem and the divergent sides is a support block 28 with a perforation 29 coincident with the center of the stem. The block ends in a hook 30. This perforation is one of four spaced in the rack. A second one is located near the base and is coincident with the one in the block. The other two are in aligned position in the arcuate members. Either two respective aligned perforations with accompanying fasteners or the hook serves a means of securing the rack to a fixture. The hook can be suspended from a horizontal rod or fasteners can pass through the perforations to anchor in a closet wall or door.

Figure 7:
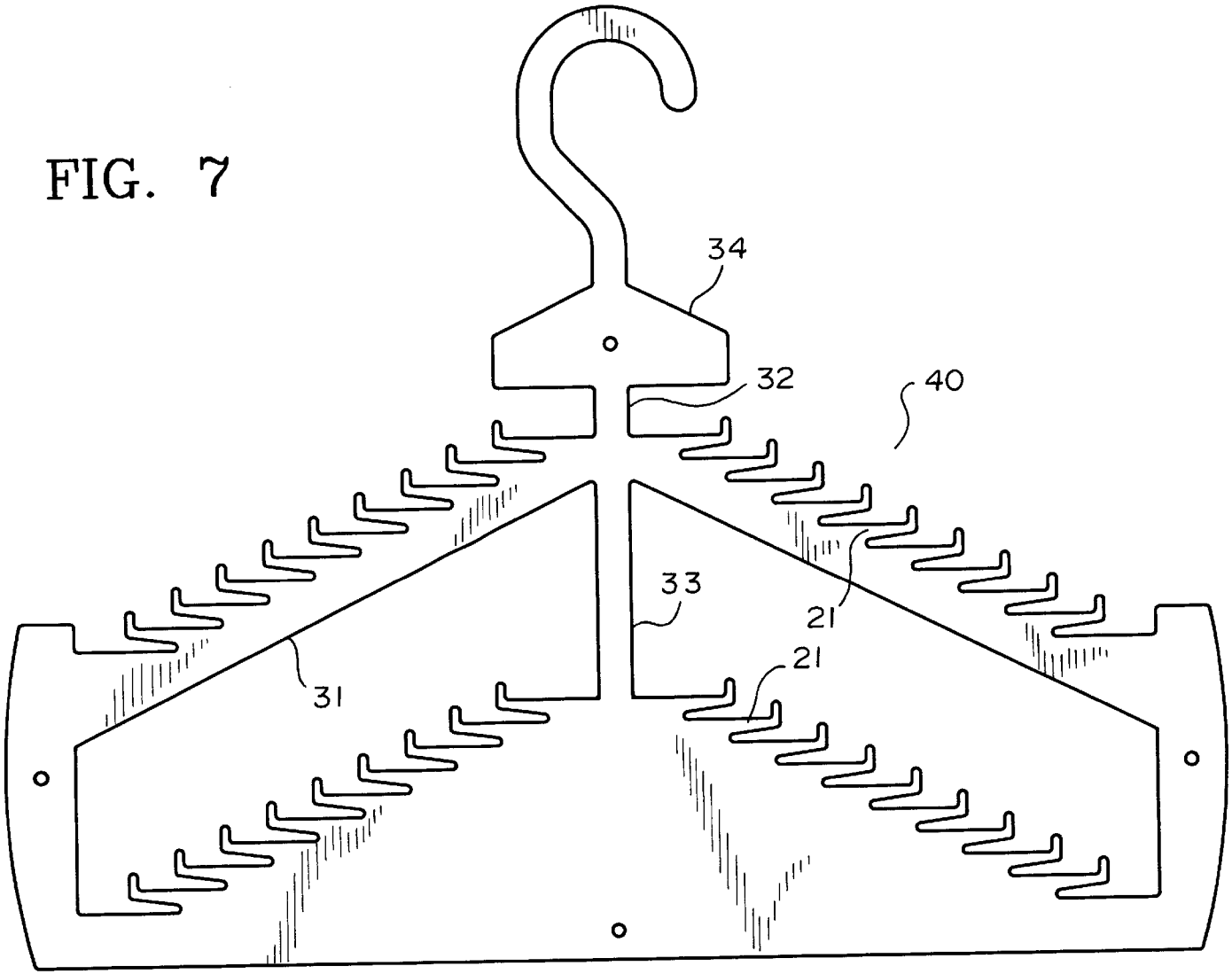
FIG. 7 is a modification of FIG. 6 showing two sets of steps wherein the second set is parallel and below the first set.

FIG. 7 is a rack 40 that differs from FIG. 6 in that there are two sets of steps 21 and two stems 32, 33, and the upper set of steps is cut out from the two downwardly diverging sides 31 and the upper set of steps extend outwardly from the bottom of upper stem 32, and the lower set extends outwardly from the bottom of lower stem 33. The lower set of steps has the configuration described above in FIG. 6. The sets of steps are parallel, symmetrically arranged with the upper set superposed over the lower set. The support block 34 is now located above the upper set of steps.

Figure 8:
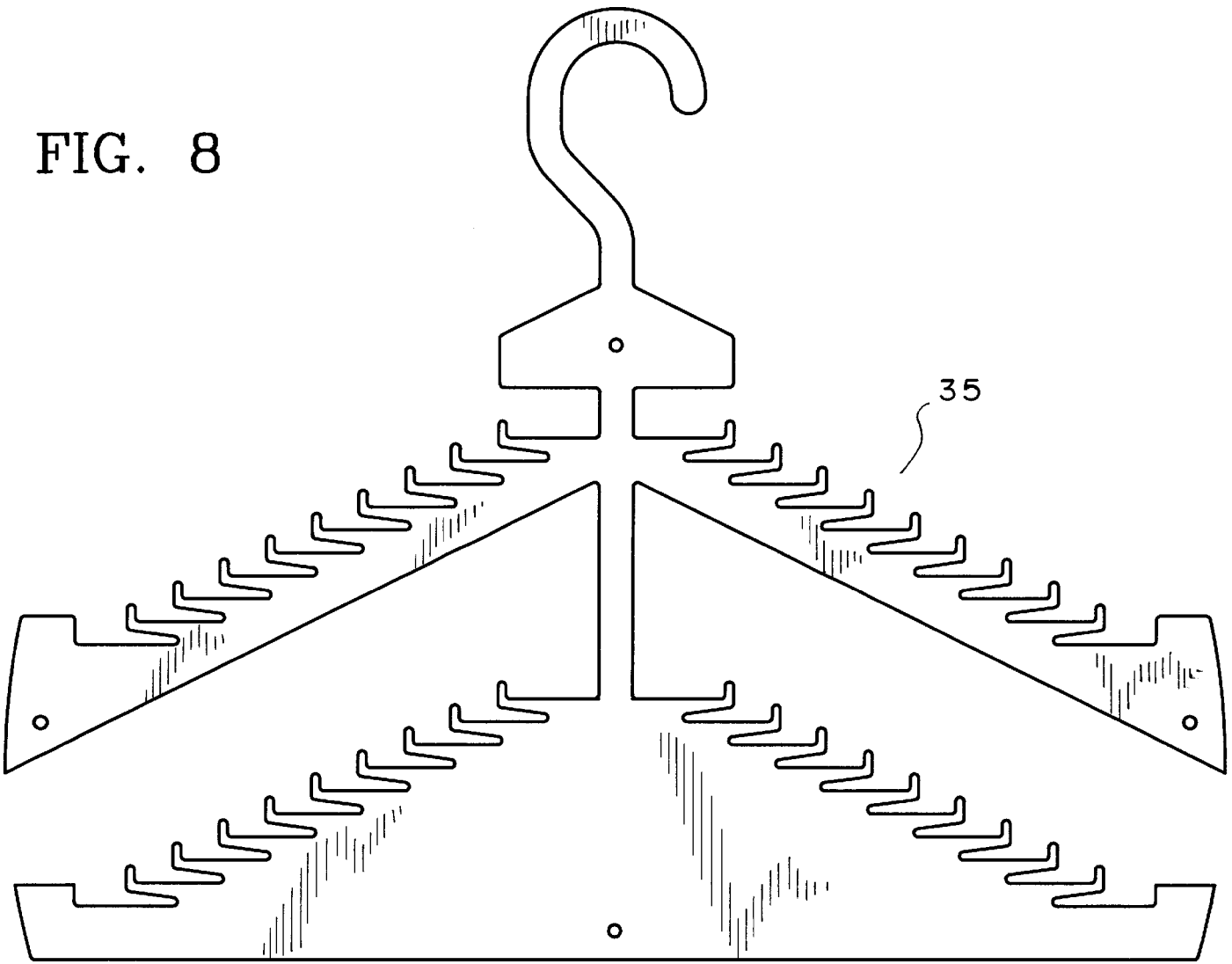
FIG. 8 shows two sets of steps as in FIG. 7 except that the steps are not joined by an arcuate member.

FIG. 8 is an apparel rack 35 like FIG. 7 having two parallel, symmetrical sets of steps with one set beneath the other wherein the essential difference is that the upper diverging sides with its steps is not joined to the lower diverging sides with its steps by an arcuate member. This rack is easier to manufacture, although it is not as stable as the rack of FIG. 7.

Figure 9:
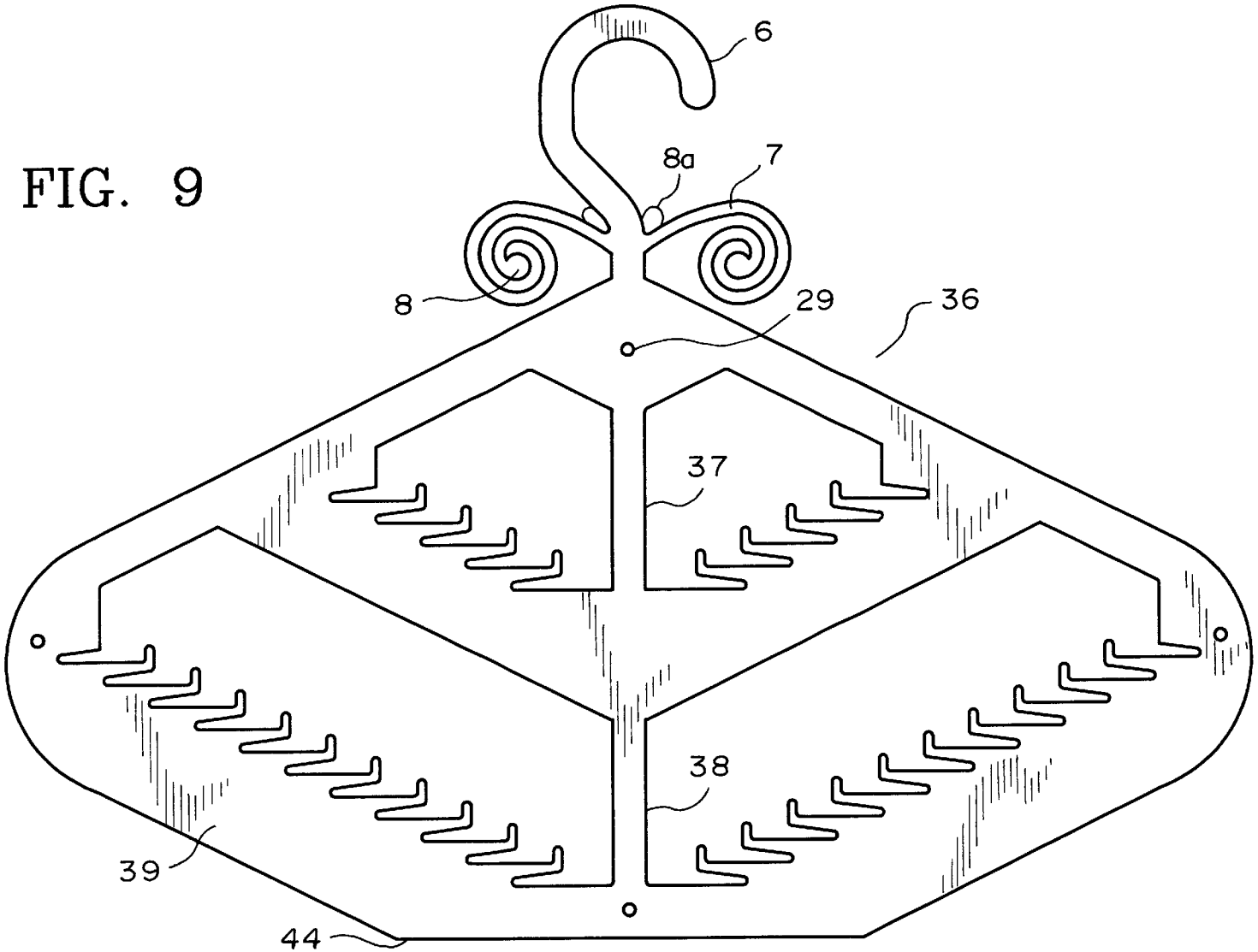
FIG. 9 is a variation of FIG. 5 of the original application wherein the steps converge toward centered stems and there are no cutouts of the frame between sets of steps.

FIG. 9 is a rack 36 similar to FIG. 5 of the original application, that is the shape similar to a baseball diamond; however there are no cutout strips between the convergent sets of steps, and there are two centered stems 37, 38 and perforations 29 as described in FIG. 6. Additionally as in FIG. 6 the support block is integral with the stem and the divergent sides. The convergent sides 39 from which cutouts for the steps are configured form an acute angle with the divergent sides of the rack. Note also the curved surfaces ending in spirals and the ringlets as in FIG. 5.

Figure 10:
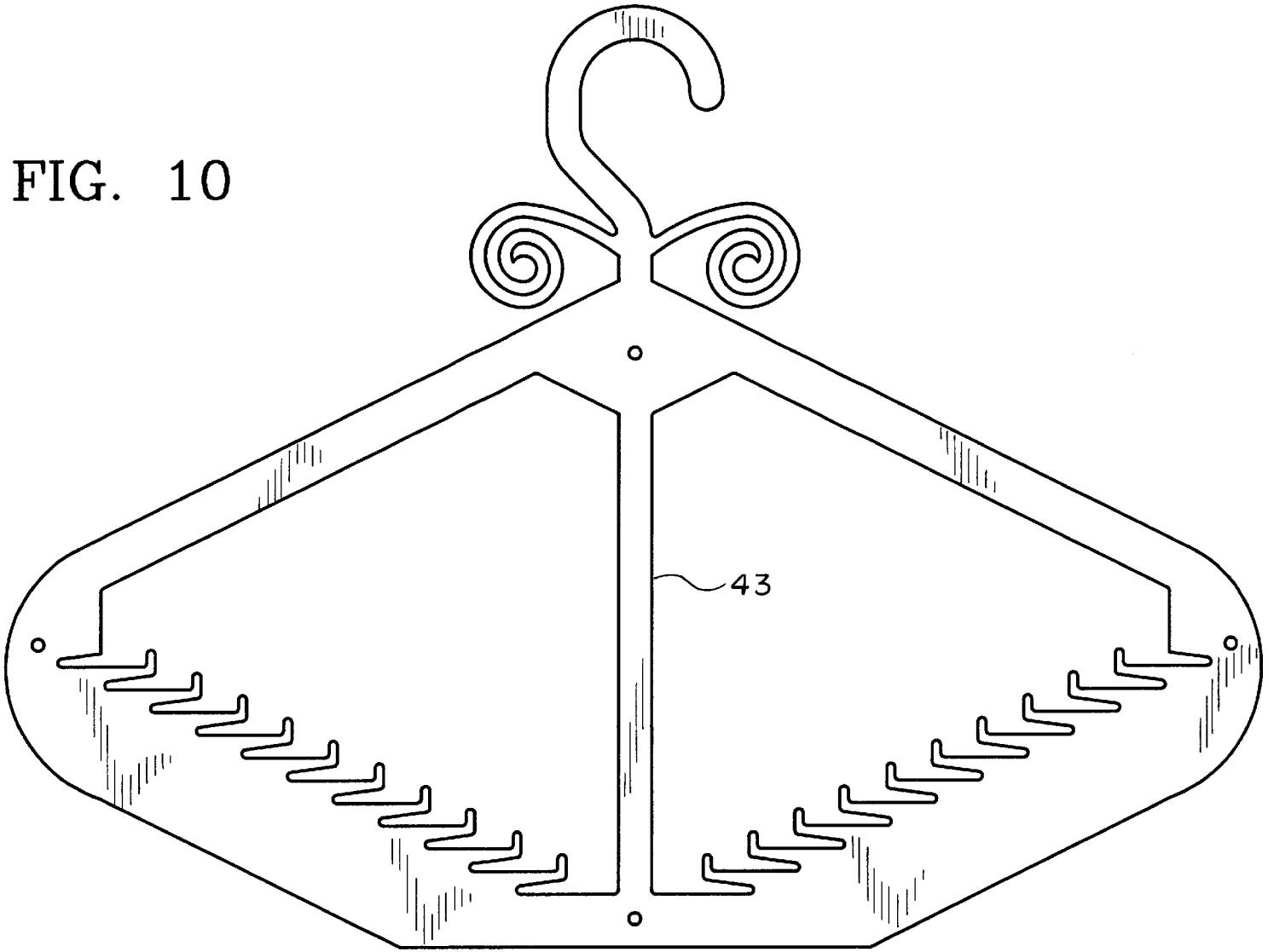
FIG. 10 is similar to FIG. 9 except there is only one set of steps.

FIG. 10 has the same configuration as FIG. 9, but differs in that the rack 36 has convergent sides with one set of steps and one long stem 43 to which the sides 39 converge.

While the devices described herein constitute the preferred embodiments, it should be understood that various modifications, alterations and changes could be made that would be obvious to those skilled in the art without departing from the scope of the invention as defined by the appended claims.

What is claimed is:

1. A rack for supporting apparel accessories such as ties, belts, scarfs comprises a flat plate of injection molded plastic in the form of a shaped figure having a frame of downwardly diverging sides that join arcuate members, said arcuate members intersecting a broad horizontal base, diverging sides enclosed within said frame parallel to said diverging sides of said frame, a set of symmetrically aligned steps being cut out from said parallel diverging sides, said steps having a short vertical leg and a longer horizontal leg, said horizontal legs extending inwardly toward a centered stem, a distance between said vertical legs increasing incrementally as said parallel sides diverge, a support block projecting upwardly from said stem, said block being integral with said stem and said diverging sides of said frame, a hook extending upwardly from said block, said horizontal legs of a last pair of steps being adjacent said horizontal member that forms a broad base, coincident apertures located at the juncture of said stem and said diverging sides of said frame said and said base, and aligned apertures located in said arcuate sections, said apertures enabling fasteners inserted therein to fix said rack to a support.

2. A rack as in claim 1 wherein there are two sets of diverging steps, a lower set and an upper set superposed above said lower set, said upper set of steps being cut out from said diverging sides of said frame, said diverging sides of said upper set of steps joining arcuate members, said lower sets of steps being cut out from diverging sides parallel to said diverging sides of said frame said horizontal legs of said two sets of steps extending toward lower and upper centered stems, a support block projecting upwardly from said upper stem and a hook integral therewith, coincident apertures at said juncture and said base and aligned apertures in said arcuate sections, said hook engaging a support member for said rack.

3. A rack as in claim 2 wherein there are two sets of diverging steps, a lower set and an upper set, each set of steps being cut out from said diverging sides, each set of steps extending downwardly from a respective lower and upper stem, said lower set and said upper set of steps being independently mounted of each other with no additional arcuate sections, said lower set of steps being adjacent a broad horizontal base, a pair of curved members extending outwardly from said support block, said curved members ending in spirals, fasteners inserted through openings in said spirals for securing said rack in a support.

4. A rack member as in claim 2 wherein said sides converge downwardly, a lower set and an upper set of symmetrically aligned steps cut out from said sides, said upper set enclosed by a frame of downwardly diverging sides said steps having short vertical legs and longer horizontal legs, said horizontal legs extending outwardly from centered stems, the distance between said vertical legs of each set of steps and a pair of centered stems decreasing incrementally as said sides converge, said lower converging side intersecting a short horizontal member at a lower end to form a base and intersecting an arcuate section at an upper end, said arcuate section joining said diverging side of said frame.

5. A rack as in claim 4 wherein the shaped figure is somewhat in the form of a baseball diamond, a support block integral with said upper stem and said diverging sides of said frame, a hook extending upwardly from said block, a pair of curved members extending outwardly from said support block, said curved members ending in spirals, a pair of ringlets located between an origin of the rack member and said curved members and fasteners inserted through openings in said spirals for securing said rack in a support.

6. A rack as in claim 5 wherein there is a single set of symmetrically aligned steps cut out from said converging sides, said horizontal legs extend away from a single centered stem, an aperture located in the center said support block, an aperture located at the arcuate sections between said divergent and convergent sides and an aperture located between said centered stem and said horizontal base, said apertures enabling fasteners to be inserted therethrough to secure said rack to a support.

7. A rack as in claim 1 wherein said shorter vertical legs of said steps serve as backups to prevent said apparel accessories from falling off said rack.

8. A rack as in claim 1 wherein said plastic is a thermosetting plastic.

9. A rack as in claim 1 wherein said shaped figure is coated with a fluorescent paint.

* * * * *